US005816343A

United States Patent [19]

Markel et al.

[11] Patent Number: 5,816,343

[45] Date of Patent: Oct. 6, 1998

[54] PHASED PERFORATING GUNS

[75] Inventors: Daniel C. Markel, Houston; Jorge E. López de Cárdenas; Victor M. Vu, both of Sugar Land, all of Tex.

[73] Assignee: Sclumberger Technology Corporation, Sugar Land, Tex.

[21] Appl. No.: 646,079

[22] Filed: Apr. 25, 1997

[51] Int. Cl.[6] ..... E21B 43/116; E21B 43/119

[52] U.S. Cl. ..... 175/4.51; 175/4.6; 166/55; 102/310; 102/321

[58] Field of Search ..... 175/4.6, 4.51; 166/55.1, 55; 102/310, 319, 321

[56] References Cited

U.S. PATENT DOCUMENTS

| | | | |
|---|---|---|---|
| 2,799,224 | 7/1957 | Long | 175/4.6 X |
| 3,100,443 | 8/1963 | Pohoriles | 175/4.6 X |
| 3,282,213 | 11/1966 | Bell et al. | 175/4.6 X |
| 3,965,993 | 6/1976 | Lavigne et al. . | |
| 4,074,756 | 2/1978 | Cooke . | |
| 4,326,462 | 4/1982 | Garcia et al. . | |
| 4,496,008 | 1/1985 | Pottier et al. . | |
| 4,583,602 | 4/1986 | Ayers . | |
| 4,694,754 | 9/1987 | Dines et al. . | |
| 4,716,833 | 1/1988 | Regalbuto . | |
| 4,739,839 | 4/1988 | Regalbuto et al. | 175/4.6 X |
| 4,753,301 | 6/1988 | Berry . | |
| 4,773,299 | 9/1988 | Oestreich et al. . | |
| 4,844,167 | 7/1989 | Clark . | |
| 4,875,413 | 10/1989 | Christopher et al. . | |
| 4,885,993 | 12/1989 | Hancock et al. . | |
| 4,951,744 | 8/1990 | Rytlewski . | |
| 4,961,365 | 10/1990 | Rytlewski . | |
| 5,063,822 | 11/1991 | Lopez de Cardenas | 175/55.1 X |
| 5,095,999 | 3/1992 | Markel . | |
| 5,241,891 | 9/1993 | Hayes et al. . | |
| 5,323,684 | 6/1994 | Umphries . | |
| 5,421,418 | 6/1995 | Nelson et al. . | |
| 5,542,480 | 8/1996 | Owen et al. | 175/4.51 |
| 5,638,901 | 6/1997 | Shirley et al. . | |
| 5,662,178 | 9/1997 | Shirley et al. . | |

FOREIGN PATENT DOCUMENTS

WO96/38652 12/1996 WIPO .

OTHER PUBLICATIONS

Schlumberger Wireline & Testing, "Schlumberger Perforating Service," pp. 4–1 to 4–68 (1995).

Owen Oil Tools, Inc., "Shogun Spiral Strip System: 1–11/16", 2–1/8" & 2–9/16" O.D., Deep Penetrator & Big Hole," pp. 5–14 (Apr. 1995).

Owen Oil Tools, Inc., "Shogun Sprial Strip System: 'Phased'–High Performance Through Tubing Perforator," p. 1 (1995).

Owen Oil Tools, Inc., OWENewsletter, vol. 5, No. 1 (date unknown).

*Primary Examiner*—Frank Tsay

*Attorney, Agent, or Firm*—Gordon G. Waggett; John J. Ryberg; John Bouchard

[57] ABSTRACT

A perforating gun having a base structure made of a deformable material. The base structure includes support rings integrally attached to one another by connector portions. The capsule charges are mounted in corresponding support rings, and each support ring is adjustable by selective deformation of the base structure to face in one of a plurality of directions to provide a plurality of combinations of phasing patterns.

18 Claims, 13 Drawing Sheets

PHASED PERFORATING GUNS

BACKGROUND

The invention relates to phased perforating guns.

Perforating guns, used in wellbores for perforating a formation, include charges mounted on a base structure. The charges are often phased, that is, pointed in different directions for perforating around the circumference of the wellbore. The charges used may be capsule charges which are each individually sealed by a capsule against corrosive fluids and elevated temperatures and pressures in the wellbore. On the other hand, if non-capsule charges are used, a carrier having a sealed housing is used to surround and protect all of the non-capsule charges from the hostile environment in the wellbore.

FIGS. 1–7 illustrate various types of perforating guns.

Referring to FIGS. 6*a* and 6*b*, examples of perforating guns in which non-capsule charges are loaded in a carrier housing are shown. In FIG. 6*a*, a perforating gun 22 includes a base structure 22*b* and non-capsule charges 22*a* mounted on the base structure. The base structure 22*b* consists of a tube having holes 22*b*1 to receive the non-capsule charges. A carrier tube 22*c* encloses and protects the unsealed charges 22*a*. The carrier tube 22*c* is sealed to prevent well fluid from damaging the charges 22*a*. The holes 22*b*1 (into which non-capsule charges are mounted) are created along the tubular base structure 22*b* in a spiral pattern. Corresponding areas of reduced wall thickness 22*d* (indicated by dashed circular lines) are created in the carrier tube 22*c* to reduce the protrusion of burrs in the carrier tube wall created by the explosive force. The phasing of the non-capsule perforating gun is determined by the position shown on the tubular base structure 22*b*.

Similarly, in FIG. 6*b*, a carrier tube 23*c* carries a base structure 22*b* having a plurality of integrally connected rings in which non-capsule charges can be mounted. The rings are configured such that the non-capsule charges are arranged in a 60°-phased pattern. Corresponding areas of reduced thickness 23*d* are created in the carrier tube 23*c*. The areas of reduced thickness 23*d* and non-capsule charges must align to ensure a minimum amount of protruding burrs are created in the outer surface of the carrier tube 22*c*. Once the gun is fired, the non-capsule charges 23*a* and base structure 22*b* break apart, but the debris remains in the carrier tube 22*b*. The carrier tube 22*b* can then be retrieved from the wellbore.

Referring to FIGS. 1*a* and 1*b*, a link-type expendable perforating gun is illustrated. In FIG. 1*a*, a gun 10 includes capsule charges 10*a* which are phased (pointed in different directions) approximately 90° from each other to perforate the formation about the circumference of the wellbore. A detonating cord 10*b* weaves around each charge for detonating the charges in response to a detonation stimulus. Each charge is connected to the next, adjacent charge via cotter pins 10*c*.

In FIG. 1*b*, a differently configured perforating gun 12 includes a plurality of capsule charges that are connected to each other via rivets 12*a*. In this configuration, the capsule charges are phased 180° from each other.

FIGS. 2*a* and 2*b* illustrate two other types of 180°-phased perforating guns, which are, respectively, wire and strip-type semi-expendable guns. In FIG. 2*a*, a perforating gun 14 includes capsule charges connected together by mounting wires 14*b*. In FIG. 2*b*, a perforating gun 16 includes capsule charges 16*a* mounted on a rigid base structure 16*b*, which is made of sheet metal with openings to receive the capsule charges 16*a*. In the embodiments of FIGS. 2*a* and 2*b*, the capsule charges are mounted to alternately point in opposite directions along the mounting structure 14*b* or 16*b*.

Referring to FIG. 3, a perforating gun 18 includes capsule charges 18*a* mounted on a straight, relatively rigid base rod 18*b*. The base rod 18*b* may be hollow, allowing a detonating cord to be inserted through the center thereof for connection to each of the charges 18*a*. The capsule charges 18*a* may be mounted onto the base 18*b* using screws.

Referring to FIG. 4, a perforating gun 20 includes a plurality of capsule charges 20*a* mounted on a base strip 20*b* that includes a metallic strip having a plurality of through-holes disposed for connection to the corresponding capsule charges 20*a*. In the embodiment shown in FIG. 4, the capsule charges 20*a* are mounted to point in only one general direction.

Referring to FIGS. 5*a* and 5*b*, a spiral strip perforating gun 21 manufactured by Owen Oil Tubes, Inc. of Ft. Worth, Tex., is illustrated. The spiral strip perforating gun 21 includes a plurality of capsule charges 21*a* mounted along a spiraling base strip 21*b*. The direction of the capsule charges 21*a* are determined by the spiral shape of the base strip 21*b* and the amount of twist between capsule charges.

Referring to FIGS. 7*a* and 7*b*, a perforating gun 24 includes capsule charges 24*b* mounted on a base strip 24*a*. The base strip 24*a* is a unitary structure that is bent generally along its center axis to form a first planar portion 24*a*2 lying in a first plane and a second planar portion 24*a*3 connected to and substantially coextensive with the first portion and lying in a second portion at an angle to the first plane. The unitary structure formed by the first and second surfaces 24*a*2 and 24*a*3 provide structural support and resistance to bending of the unit. The capsule charges 24*b* are alternately connected to the first and second portions 24*a*2 and 24*a*3 of the base strip 24*a*, as shown in FIG. 7*b*.

The base strip 24*a* includes recesses 24*a*1 alternately carved into the first and second surfaces 24*a*2 and 24*a*3, each recess 24*a*1 being shaped to receive the circumferential shape of a capsule charge 24*b*. The capsule charge 24*b* is held in place on a corresponding surface of the base strip by a mounting bracket 24*c*. A detonating cord 26 is connected to each charge 24*b*.

The base strip 24*a* is made of hardened steel, and the mounting brackets 24*c* are each made of mild steel, e.g., plain carbon steel. The mounting brackets 24*c* may be physically connected to base strip 24*a* by a pair of screws. When a charge detonates, the associated mounting bracket breaks to allow the spent charge casing to fall to the bottom of the wellbore. However, the base strip 24*a* itself can withstand detonation of the charges 24*b* and will not shatter when the charges 24*b* detonate and may be retrieved from the wellbore. The perforating gun 24 is further described in U.S. Pat. No. 5,095,999, entitled "Through Tubing Perforating Gun Including a Plurality of Phased Capsule Charges Mounted on a Retrievable Base Strip Via a Plurality of Shatterable Support Rings," assigned to the Assignee of the present application.

SUMMARY

In general, in one aspect, the invention features a perforating gun having a base structure made of a deformable material, the base structure including capsule charge supports integral with the base structure. The capsule charges are mounted in corresponding supports, each support being adjustable by selective deformation of the base structure to face in one of a plurality of directions to provide a plurality of combinations of phasing patterns.

Implementations of the invention may include one or more of the following features. The supports include support rings and the base structure includes connector portions integrally connecting successive support rings. The base structure is preformed for a predetermined size and number of capsule charges. The length of each connector portion is selectable to vary the number of capsule charges mounted in the base structure. The plurality of combinations of phasing patterns include the following: 0°-phased pattern, 45° clockwise helix pattern, and +45°/0°/−45° twisted pattern. The base structure is made of a material including sheet metal. The base structure is made of a material selected from the group consisting of steel, aluminum, copper, and nickel.

In general, in another aspect, the invention features a perforating gun having a support member having openings disposed therethrough, each opening configurable to face in any one of a plurality of directions. Capsule charges are mounted in the openings.

In general, in another aspect, the invention features a method of arranging a perforating gun to shoot in one of a plurality of combinations of phasing patterns. A perforating gun is provided having a base structure made of a deformable material and including capsule charge supports integral with the base structure. Each support ring is twisted to face in any one of a plurality of directions. Capsule charges are mounted in the support rings.

In general, in another aspect, the invention features a method of arranging a perforating gun to shoot in one of a plurality of combinations of phasing patterns. A perforating gun is provided the includes a base structure having openings disposed therethrough. Each opening is arranged to face in any one of a plurality of directions. Capsule charges are mounted in the openings.

Implementations of the invention may include one or more of the following advantages. The perforating gun offers improves flexibility by allowing different combinations of phasing patterns. Less material is used in the perforating gun, thereby generating less debris after perforation. Distances between capsule charges can be adjusted to vary the shot density of the gun. The perforating gun is expendable. The perforating gun is mountable to be closer to one side of the inner wall of a casing, and therefore, the efficiency is better for shooting from charges closer to the wall.

BRIEF DESCRIPTION OF THE DRAWINGS

FIGS. 7*a* and 7*b* are diagrams of a differently configured phased, capsule charge perforating gun.

FIGS. 10*a* and 10*b* are top- and side-view diagrams of a perforating gun arranged in a twisted −45°/0°/45° pattern.

DETAILED DESCRIPTION

Figure 1A:
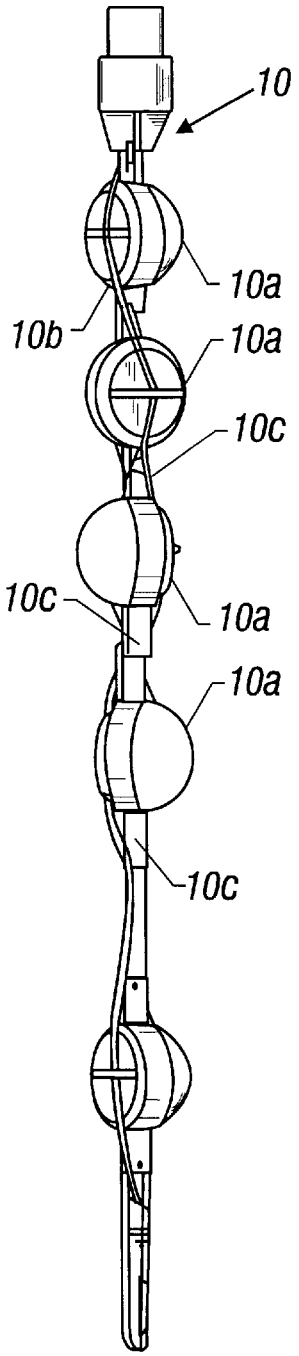
FIGURE 1A (PRIOR ART)
FIGS. 1*a* and 1*b* are diagrams of link-type expendable perforating guns.
Figure 1B:
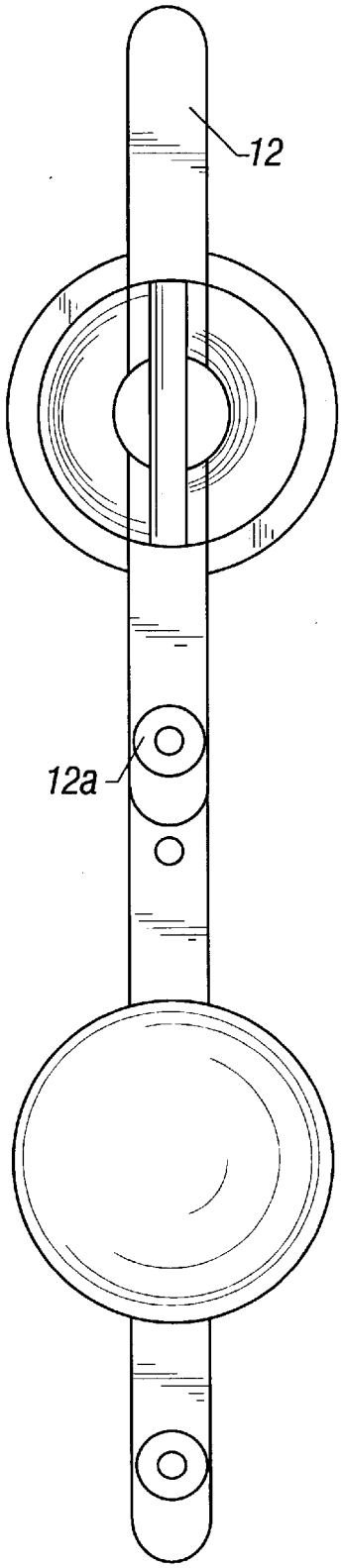
FIGURE 1B (PRIOR ART)
Figure 2A:
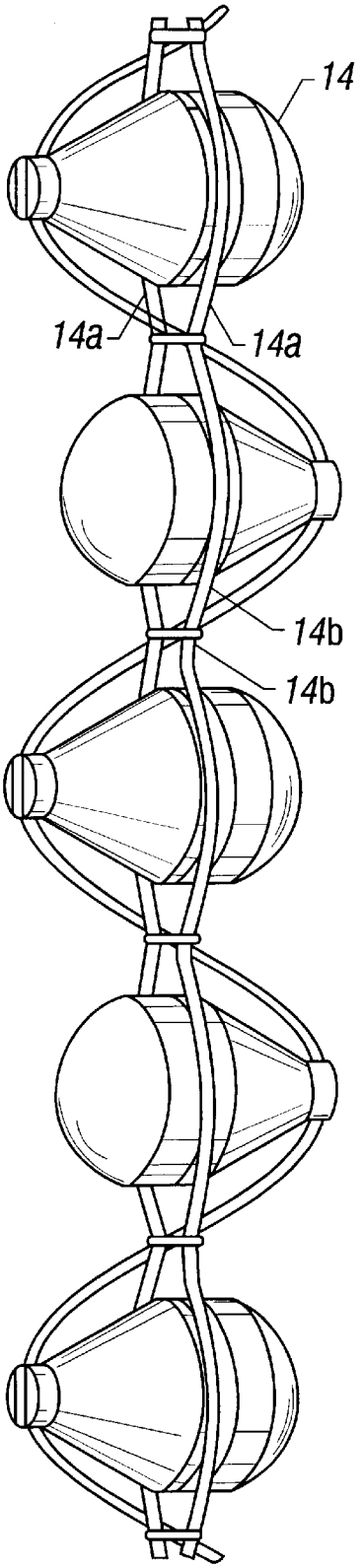
FIGURE 2A (PRIOR ART)
FIGS. 2*a* and 2*b* are diagrams of wire and strip-type semi-expendable guns.
Figure 2B:
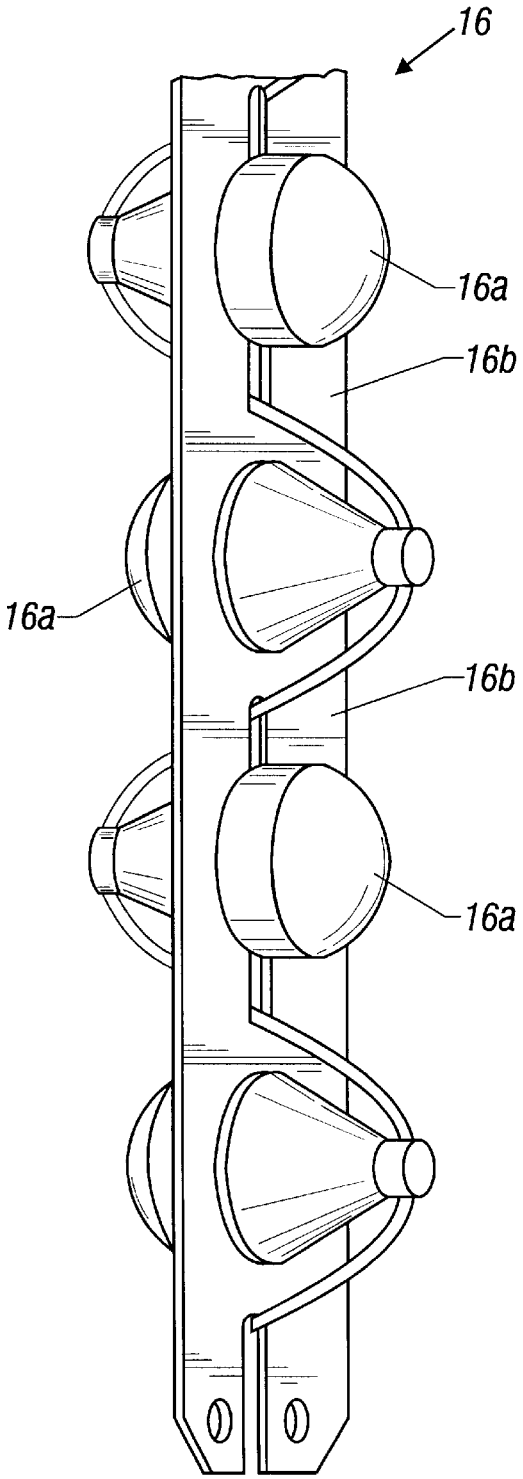
FIGURE 2B (PRIOR ART)
Figure 3:
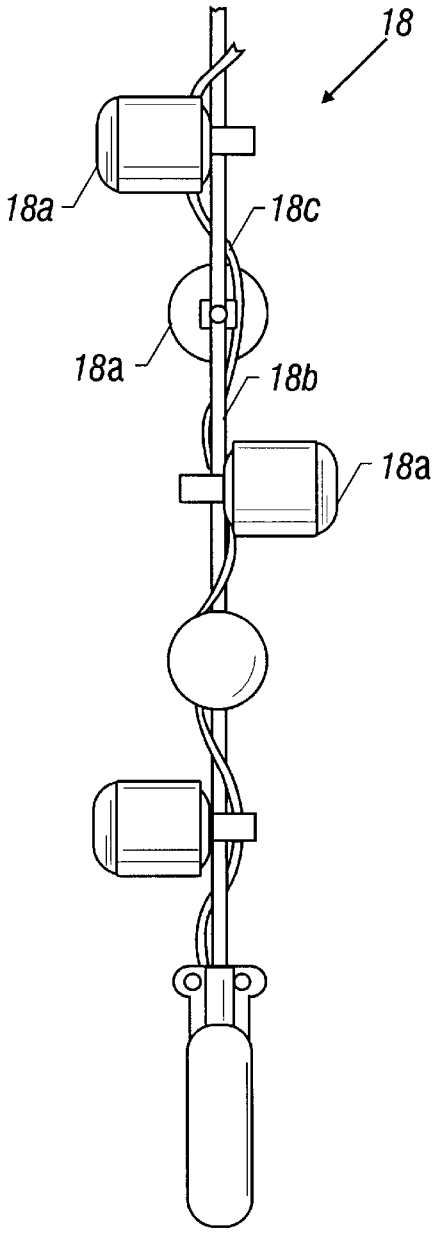
FIGURE 3 (PRIOR ART)
FIG. 3 is a diagram of a capsule charge, phased perforating gun.
Figure 4:
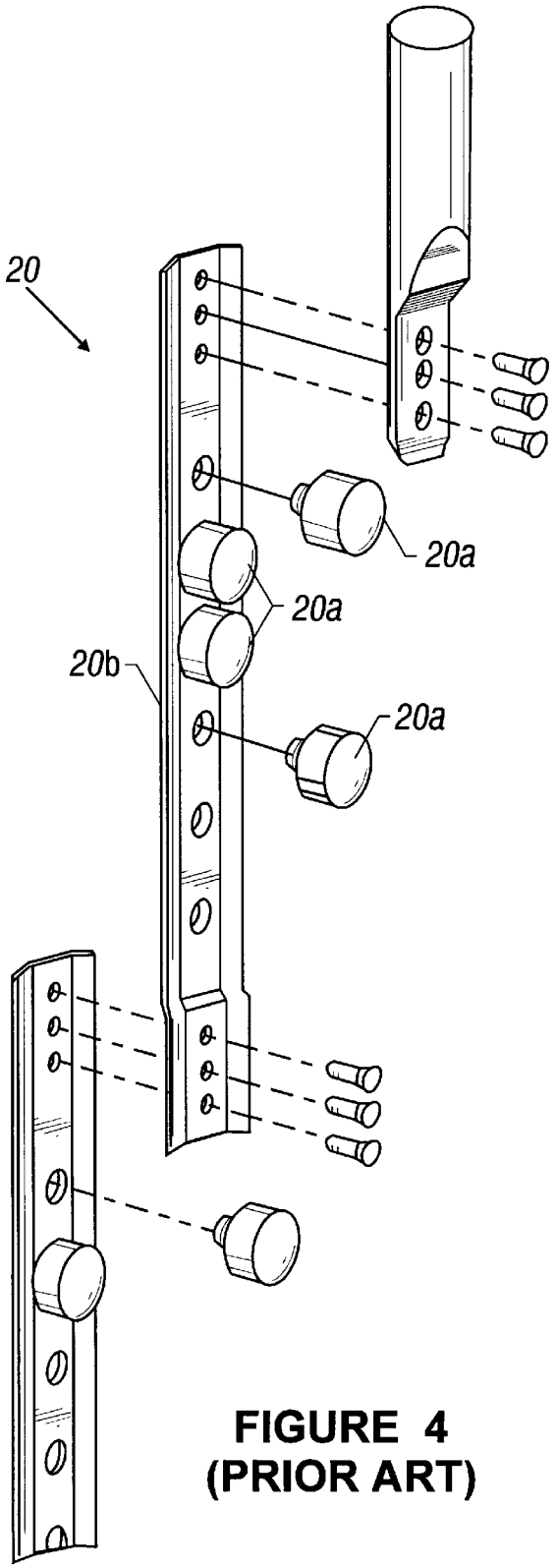
FIGURE 4 (PRIOR ART)
FIG. 4 is a diagram of a capsule charge, non-phased perforating gun.
Figure 5A:
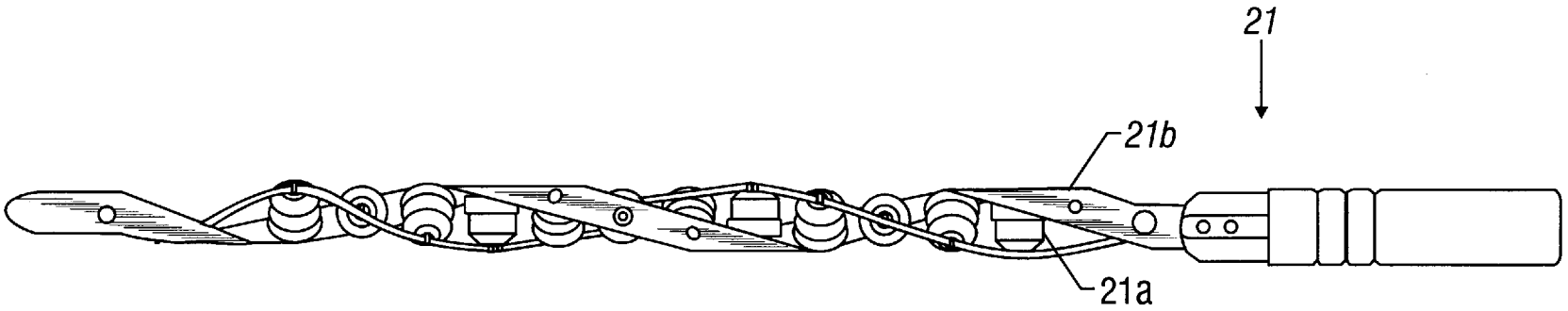
FIG. 5 is a diagram of a spiral-type capsule charge perforating gun.
Figure 5B:
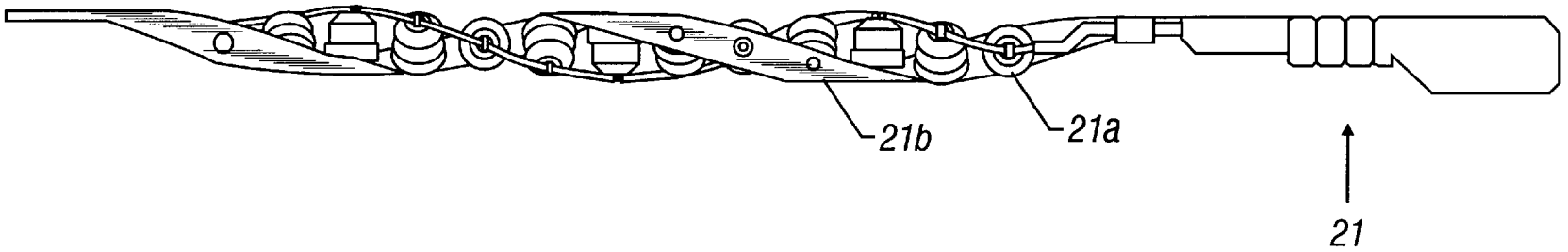
Figure 6A:
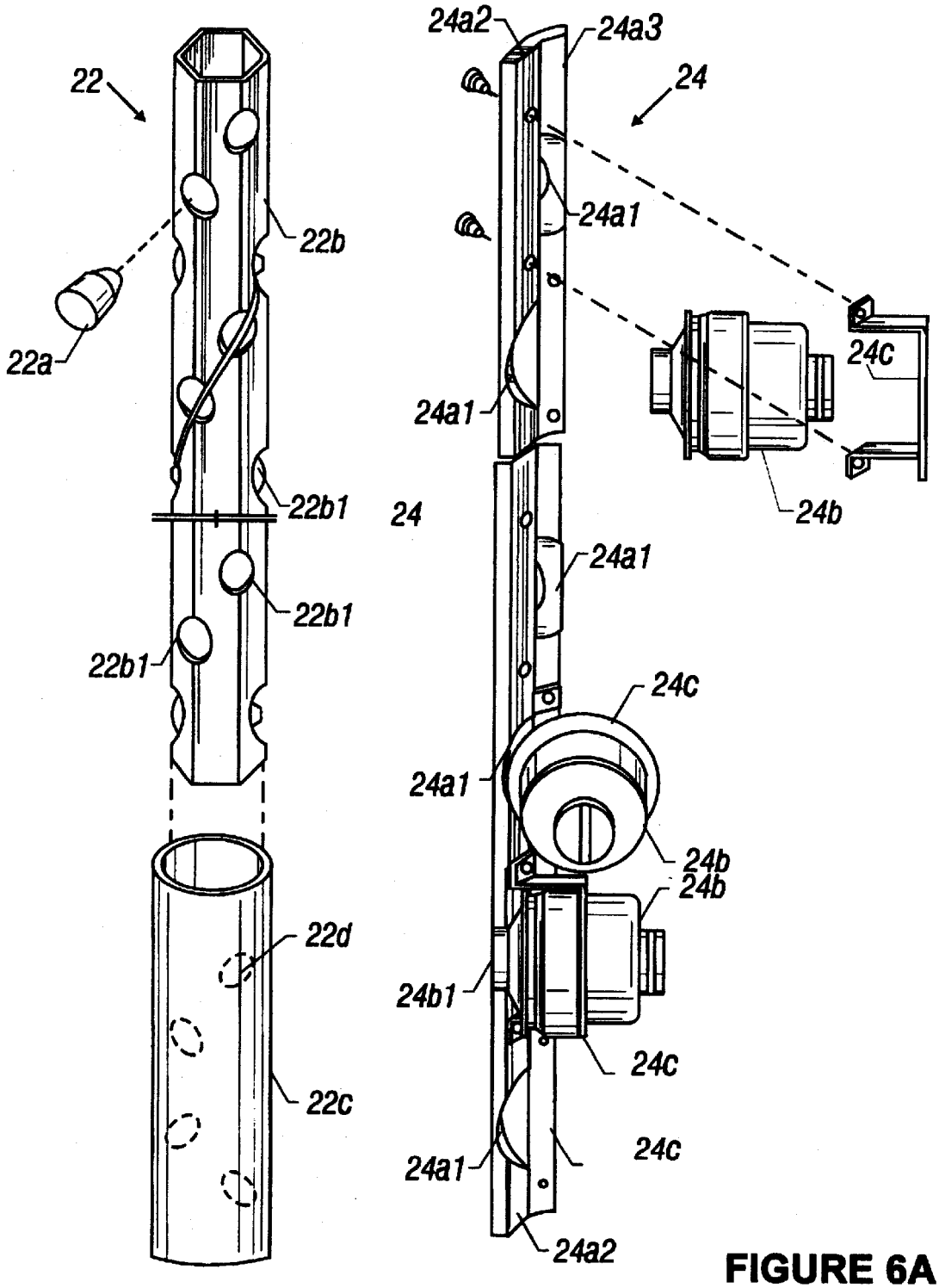
FIGURE 6A (PRIOR ART)
FIGS. 6*a* and 6*b* are diagrams of a phased, non-capsule charge perforating guns.
Figure 6B:
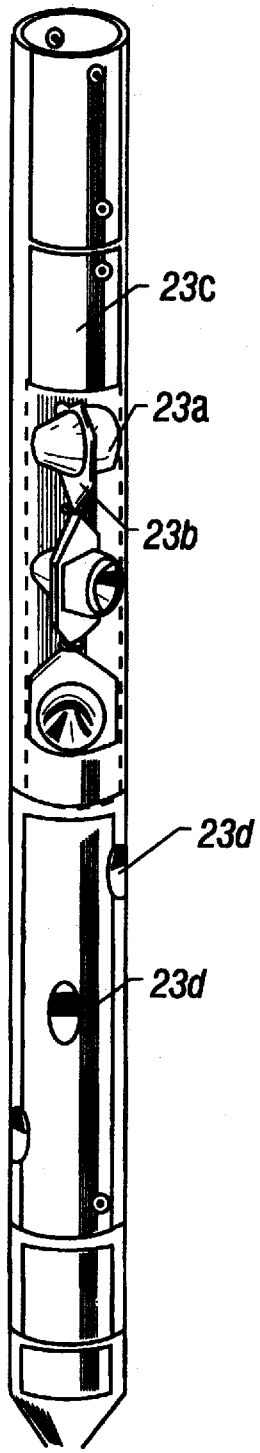
FIGURE 6B (PRIOR ART)
Figure 7B:
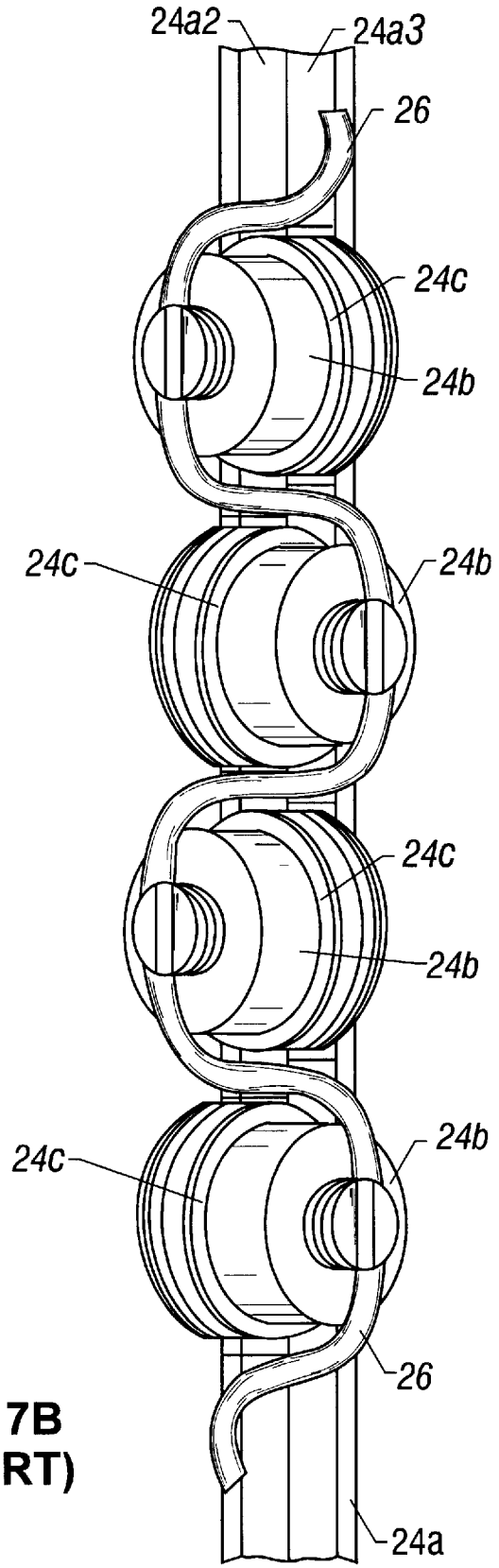
FIGURE 7B (PRIOR ART)
Figure 8A:
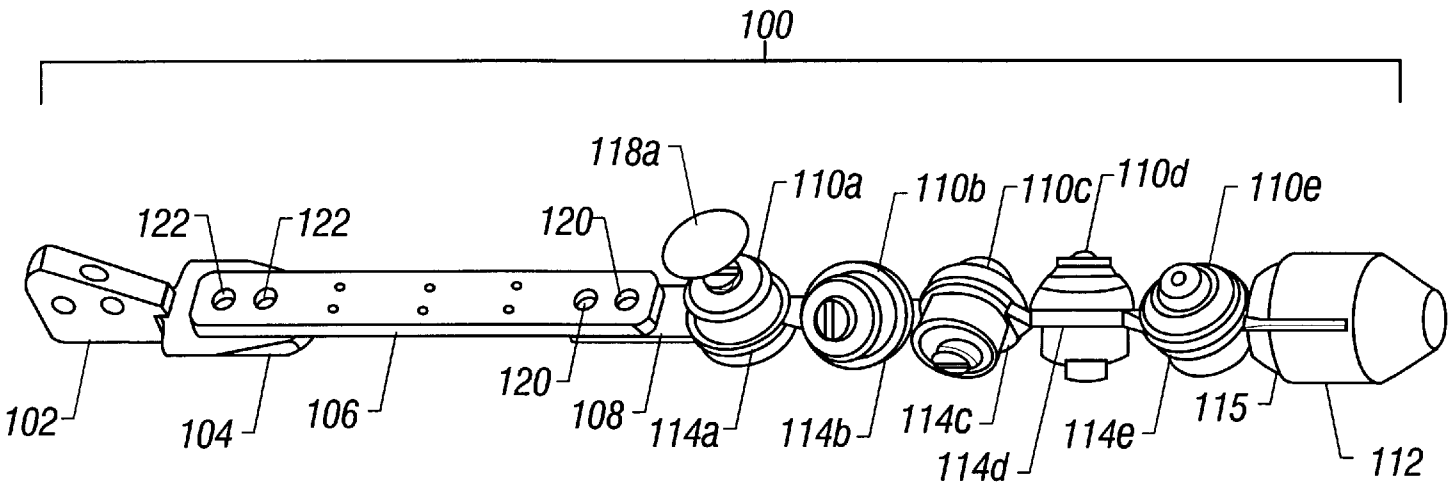
FIG. 8*a* is a diagram of a perforating gun having support rings integrally connected for receiving capsule charges.

Referring to FIG. 8*a*, an expendable perforating gun 100 includes a base strip 108 that forms support rings 114*a*–114*e* to receive capsule charges 110*a*–110*e*, respectively. Each of the capsule charges 110 is secured to a corresponding support ring 114 by a retaining ring 118. Other methods of retaining the capsule charge to the base strip 108 can be utilized, such as using cotter pins or bendable tabs.

Figure 8B:
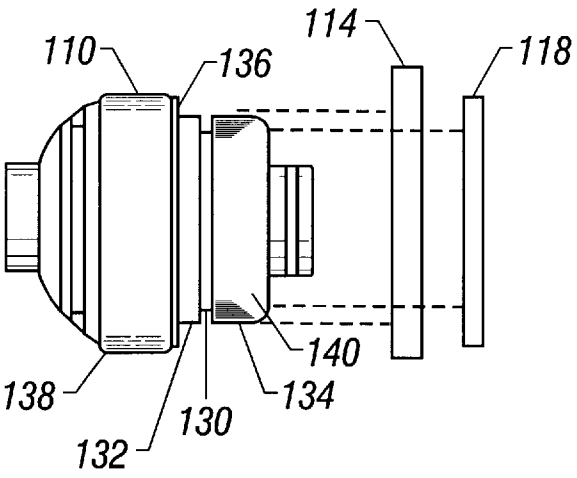
FIG. 8*b* is a diagram of a capsule charge for mounting to the perforating gun of FIG. 8*a*.

Referring to FIG. 8*b*, each capsule charge 110 includes a capsule housing that has a lower portion 138 with a first diameter and an upper portion 140 with a second diameter, the second diameter being smaller than the first diameter. This allows the upper portion 140 to be fitted through the opening in the support ring 114. The capsule charge 110 is inserted through the support ring 114 until a shoulder 136 provided by the lower portion 138 contacts the inner surface 142 of the support ring 114. The upper portion 140 of the capsule housing has a groove 130 in which the retaining ring 118 is inserted to lock the capsule charge 110 against the support ring 114.

The base strip 108 is a single, continuous linking device that connects the capsule charges. The base strip 108 is made of a deformable material, such as malleable steel sheet metal, for example, 1075 hot rolled steel. However, other deformable materials, such as any ductile sheet metal or ductile plate metal that can include aluminum, copper, stainless steel, or nickel, may be used.

The base strip 108 is twistable so that the rings 114*a*–114*e* face in different selectable directions, thereby permitting the capsule charges to shoot in many different combinations of phasing patterns. Thus, for example, using the perforating gun 100, the capsule charges can be arranged in a 0°-phased pattern (in which all the charges fire in one direction), a tri-directional pattern (e.g., −45°/0°/+45° phased firing), or a continuous 45° spiral pattern (in which adjacent charges are shot at 45° with respect to a previous charge). Because the base strip may be manipulated to permit each support ring 114 to face in many directions, the possible combinations of phasing patterns are numerous, with examples shown in FIGS. 9–12.

A further advantage of the perforating gun 100 is that the distances between the rings 114 on the base strip 108 can be selected to vary the shot density, that is, the number of shots per given length. Thus, the charges 110 can be spaced such that they barely touch each other, or they can be spaced a large distance apart. In addition, the perforating gun 100 is fully expendable. Each support ring 114 on the base strip 108 receives the maximum impact of the explosion when a corresponding capsule charge is fired, and both the support ring 114 and the adjacent portions of the base strip 108 surrounding the exploding capsule charge are broken into small pieces.

After the perforating gun 100 is fired, the base strip 108 shatters and drops to the bottom of the wellbore along with a terminating knob 12, with the remainder of the perforating gun 100, including mounting brackets 102, 104, and 106, being retrieved from the wellbore afterwards. Because of the small amount of material used to form the base strip 108 and the rings 114, the amount of debris that falls to the bottom of the wellbore after the base strip 108 is shattered is reduced relative to many prior designs.

To manufacture, the base strip 108 can be laser cut from sheet metal. Alternatively, the base strip 108 can also be machined or punched from metal, or it can be manufactured as a casting.

The base strip 108 at its bottom end has a member 115 that connects to the terminating knob 112. At its top end, the base strip 108 is attached to a first mounting bracket 106 by means of nuts and bolts fitted through openings 120. The top end of the mounting bracket 106 has openings 122 through which bolts are threaded to attach the mounting bracket 106 to a connector piece 104. The connector piece 106 in turn is connected to a second mounting bracket 102 that attaches the perforating gun 100 to the rest of the perforating apparatus, including a firing head.

FIGS. 9–12 illustrate different embodiments of the perforating gun 100.

Figure 9A:
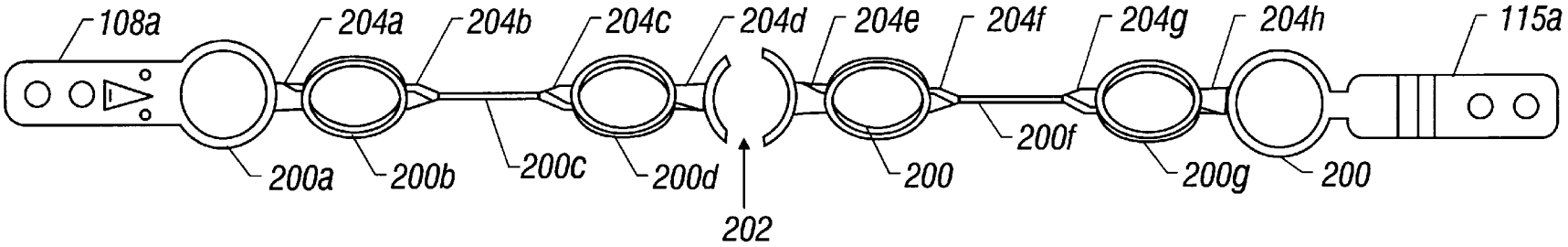
FIGS. 9*a* and 9*b* are top- and side-view diagrams of a perforating gun arranged in a 45° right-hand clockwise helix pattern.
Figure 9B:
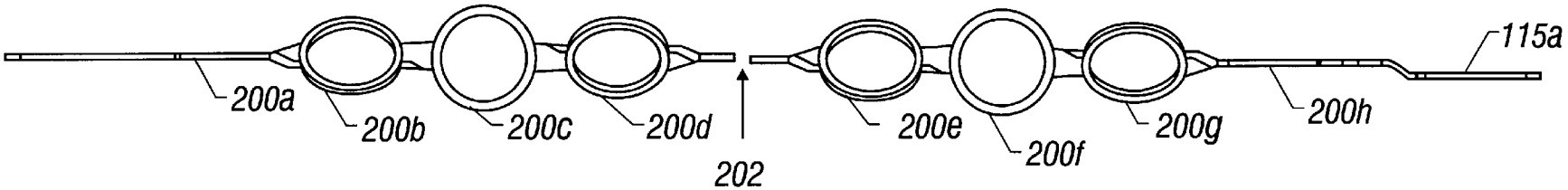

Referring to FIGS. 9*a* and 9*b*, the base strip 108*a* includes rings 200*a*–200*f*, twisted in a 45° (±1°) right-hand clockwise helix pattern. The break 202 shown in the drawing indicates that any number of rings 200 can be inserted. The rings 200*a*–200*h* are integrally attached to one another by means of integral connectors 204*a*–204*h*. Because the connectors 204*a*–204*h* are deformable, they can be twisted such that the rings 200*a*–200*h* face in any one of numerous directions. In the embodiment of FIGS. 9*a* and 9*b*, going from the top of the gun 100 down, the rings 200*a*–200*h* are arranged such that each successive ring is at a clockwise 45° angle with respect to the previous ring. Thus, if the ring 200*a* lies in a reference plane, then the ring 200*b* lies in a plane B that is at a 45° angle with respect to the reference plane. The next ring 200*c* lies in a plane C at a 45° angle with respect to the plane B and at a 90° angle with respect to the reference plane.

The lengths of the connectors 204*a* and 204*b* are also selectable to vary the shot density of the perforating gun. Using the base strip 108 with capsule charges each having a longitudinal diameter of 1 11/16", a shot density of 7 shots per foot (SPF) can be achieved. For 2⅛" capsule charges, a shot density of 6 SPF can be achieved. For 2½" capsule charges, a shot density of 5 SPF can be achieved.

By varying the shot density, fluid flow profiles from perforated formations surrounding a wellbore can be configured to optimize well production.

Figure 10A:
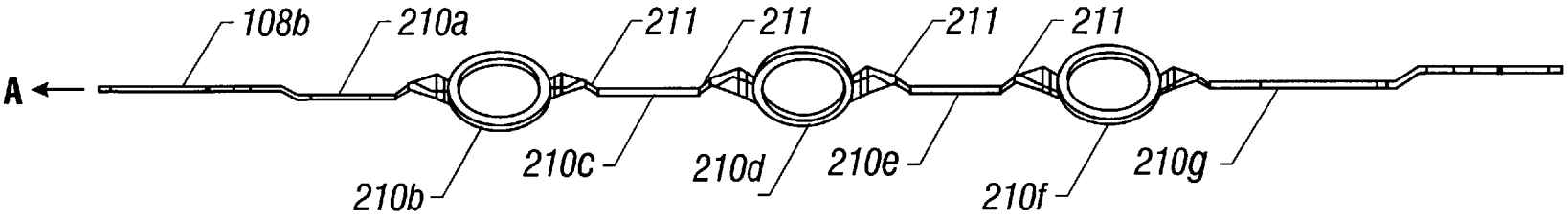
Figure 10A:
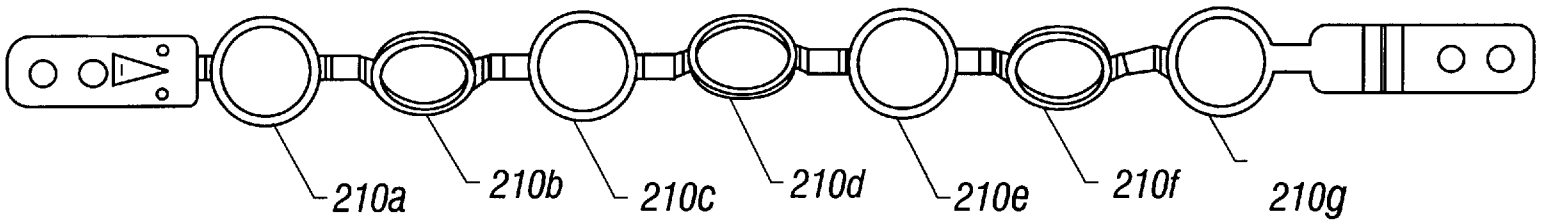

FIGS. 10*a* and 10*b* illustrate a base strip 108*b* arranged in which the rings 210*a*–210*g* are arranged in a twisted 45°/0°/−45° (±1°) pattern. The rings 210*a*–210*g* are arranged in the following sequence: 210*a* in a reference plane; 210*b* in a plane B that is at a +45° angle with respect to the reference plane; 210*c* in a plane C that is at a −45° angle with respect to plane B; 210*d* is in a plane at a −45° angle with the respect to the plane C; 210*e* is in a plane E that is at a +45° angle with respect to the plane D; 210*f* is in a plane F that is at a +45° angle with respect to the plane E; and 210*g* is in a plane G that is at a −45° angle with respect to the plane F.

Another feature of the base strip 108 of the perforating gun 100 is that the rings in the base strip can be adjusted to compensate for the different sized capsule charges such that the capsule charges all sit along generally a center axis extending along the gun 100. For example, in FIGS. 10*a* and 10*b*, bent portions 211 can be created in the integral connectors between rings 210*a*–210*g* such that the center of each capsule charge is mounted generally along a center axis A—A of the gun 100.

Figure 11A:
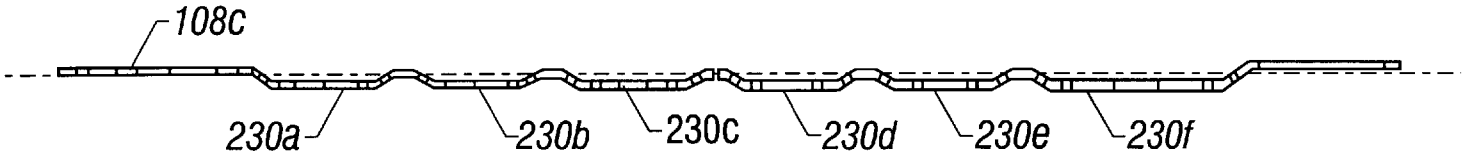
FIGS. 11*a* and 11*b* are top- and side-view diagrams of a perforating gun arranged in a 0°-phased pattern.
Figure 11B:
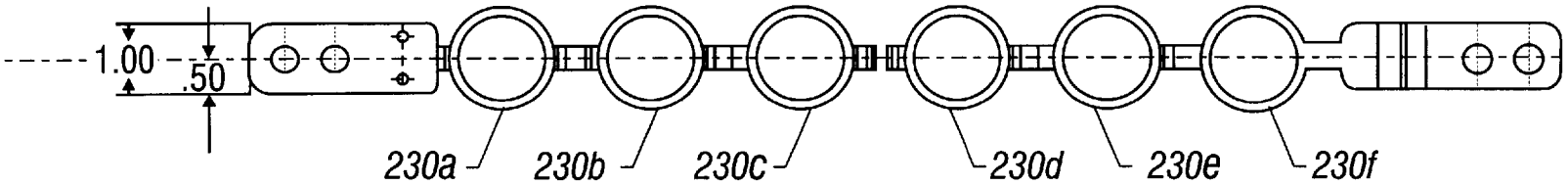

FIGS. 11*a* and 11*b* illustrate a base strip 108*c* having rings 230*a*–230*f* arranged in a 0°-phased pattern, that is, all capsule charges are mounted to point generally in one direction.

Figure 12:
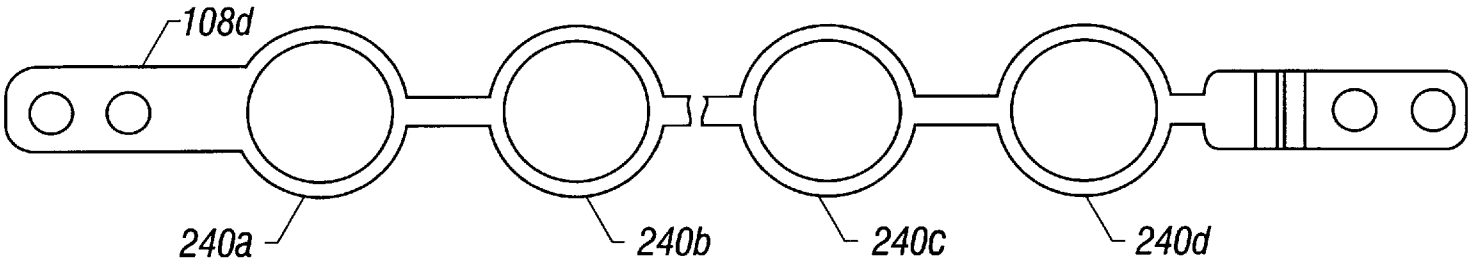
FIG. 12 is a diagram of a perforating gun having widely spaced apart support rings to achieve a reduced shot density.

As shown in FIG. 12, a base strip 108*d* includes support rings 240*a*–240*d* in which the spacing between adjacent support rings 240 is increased to reduce the shot density of the perforating gun 100. As illustrated, the integral connectors between successive support rings are lengthened to decrease the number of rings per unit length.

Since a capsule charge can be arranged at any arbitrary angle with respect to adjacent charges, any number of other combinations of phasing patterns of capsule charges can be implemented with the base strip 108.

Thus, the perforating gun 100 offers improved flexibility by allowing different combinations of phasing patterns. In addition, a relatively small amount of material (and therefore a relatively small amount of debris after perforation) is used. The distance between adjacent rings can be adjusted to vary the shot density of the gun as desired. Because the base strip 108 is narrow relative to the diameter of a cased wellbore, the base strip 108 can be positioned closer to one side to achieve better efficiency for shooting charges closer to the casing wall.

Other embodiments are within the scope of the following claims.

What is claimed is:

1. A perforating gun, comprising:

a base structure made of a deformable material, the base structure including capsule charge supports integral with the base structure; and capsule charges mounted in corresponding supports, each support being adjustable by selective deformation of the base structure to face in one of a plurality of directions to provide a plurality of combinations of phasing patterns.

2. The perforating gun of claim 1, wherein the supports include support rings and the base structure further includes connector portions integrally connecting successive support rings.

3. The perforating gun of claim 2, wherein the base structure is preformed for a predetermined size and number of capsule charges.

4. The perforating gun of claim 2, wherein the length of each connector portion is selectable to vary the number of capsule charges mounted in the base structure.

5. The perforating gun of claim 1, wherein the plurality of combinations of phasing patterns include the following: 0°-phased pattern, 45° clockwise helix pattern, and +45°/0°/−45° twisted pattern.

6. The perforating gun of claim 1, wherein the base structure is made of a material including sheet metal.

7. The perforating gun of claim 1, wherein the base structure is made of a material selected from the group consisting of steel, aluminum, copper, and nickel.

8. A perforating gun, comprising:

a support member having openings disposed therethrough, each opening configurable to face in any one of a plurality of directions; and capsule charges mounted in the openings.

9. The perforating gun of claim 8, wherein the distance between successive openings is selectable to vary the number of capsule charges mounted in the base structure.

10. The perforating gun of claim 8, wherein the openings can be arranged to provide a plurality of phasing patterns.

11. The perforating gun of claim 10, wherein the plurality of phasing patterns include the following: 0°-phased pattern, 45° clockwise helix pattern, and +45°/0°/−45° twisted pattern.

12. A method of arranging a perforating gun to shoot in one of a plurality of combinations of phasing patterns, the method comprising:

providing a perforating gun having a base structure made of a deformable material and including capsule charge supports integral with the base structure;

twisting each support ring to face in any one of a plurality of directions; and mounting capsule charges in the support rings.

13. The method of claim 12, further comprising:

adjusting the distance between successive rings to vary shot density.

14. The method of claim 12, wherein the plurality of phasing patterns include the following: 0°-phased pattern, 45° clockwise helix pattern, and +45°/0°/−45° twisted pattern.

15. The method of claim 12, further comprising:

preforming the base structure for a predetermined size and number of capsule charges.

16. A method of arranging a perforating gun to shoot in one of a plurality of combinations of phasing patterns, the method comprising:

providing a perforating gun including a base structure having openings disposed therethrough;

arranging each opening to face in any one of a plurality of directions; and mounting capsule charges in the openings.

17. The method of claim 16, further comprising:

adjusting the distance between successive openings to adjust shot density.

18. The method of claim 16, wherein the plurality of phasing patterns include the following: 0°-phased pattern, 45° clockwise helix pattern, and +45°/0°/−45° twisted pattern.

* * * * *